US011545745B2

(12) United States Patent
Zhao et al.

(10) Patent No.: US 11,545,745 B2
(45) Date of Patent: Jan. 3, 2023

(54) ANTENNA AND COMMUNICATIONS DEVICE

(71) Applicant: HUAWEI TECHNOLOGIES CO., LTD., Guangdong (CN)

(72) Inventors: Jie Zhao, Nanjing (CN); Michael Kadichevitz, Hod Hasharon (IL); Xiao Zhou, Shanghai (CN); Zui Tao, Nanjing (CN)

(73) Assignee: HUAWEI TECHNOLOGIES CO., LTD., Guangdong (CN)

( * ) Notice: Subject to any disclaimer, the term of this patent is extended or adjusted under 35 U.S.C. 154(b) by 0 days.

(21) Appl. No.: 17/323,422

(22) Filed: May 18, 2021

(65) Prior Publication Data

US 2021/0367333 A1 Nov. 25, 2021

(30) Foreign Application Priority Data

May 20, 2020 (CN) ..... 202010431622.5

(51) Int. Cl.
*H01Q 1/52* (2006.01)
*H01Q 21/00* (2006.01)
(Continued)

(52) U.S. Cl.
CPC ..... *H01Q 1/52* (2013.01); *H01Q 1/50* (2013.01); *H01Q 9/285* (2013.01); *H01Q 19/28* (2013.01);
(Continued)

(58) Field of Classification Search
CPC ..... H01Q 1/50; H01Q 1/52; H01Q 1/521; H01Q 1/523; H01Q 1/525; H01Q 1/2291;
(Continued)

(56) References Cited

U.S. PATENT DOCUMENTS

2002/0084943 A1 7/2002 Tsai et al.
2013/0169494 A1 7/2013 Hung et al.
(Continued)

FOREIGN PATENT DOCUMENTS

CN 102709673 A 10/2012
CN 109411903 A 3/2019
WO 2015109995 A1 7/2015

OTHER PUBLICATIONS

Farid Jolani et al., "A Novel Broadband Omnidirectional Dual Polarized MIMO Antenna for 4G LTE Applications",2014 IEEE International Wireless Symposium (IWS 2014),total 4 pages.
(Continued)

*Primary Examiner* — Robert Karacsony
(74) *Attorney, Agent, or Firm* — Womble Bond Dickinson (US) LLP

(57) ABSTRACT

The application provides an antenna and a communications device, and pertains to the field of antenna technologies. The antenna includes a horizontally polarized antenna and a vertically polarized antenna that are disposed in a superposition manner. The horizontally polarized antenna includes a metal sheet, and the metal sheet can be separately connected to a double-sided parallel strip line in the horizontally polarized antenna and a first conductor of a coaxial cable. A diameter of a maximum inscribed circle of the metal sheet is greater than a line width of the double-sided parallel strip line, and both the metal sheet and the coaxial cable are located on a first side of a substrate. Therefore, the metal sheet can effectively suppress an induced current in the coaxial cable, and impact of the induced current on the vertically polarized antenna can be reduced.

20 Claims, 6 Drawing Sheets

(51) Int. Cl.

| | |
|---|---|
| ***H01Q 19/28*** | (2006.01) |
| ***H01Q 21/24*** | (2006.01) |
| ***H01Q 21/20*** | (2006.01) |
| ***H01Q 21/28*** | (2006.01) |
| ***H01Q 9/28*** | (2006.01) |
| ***H01Q 1/50*** | (2006.01) |
| ***H01Q 1/22*** | (2006.01) |

(52) U.S. Cl.
CPC ..... *H01Q 21/0075* (2013.01); *H01Q 21/205* (2013.01); *H01Q 21/24* (2013.01); *H01Q 21/28* (2013.01); *H01Q 1/2291* (2013.01)

(58) Field of Classification Search
CPC ..... H01Q 9/285; H01Q 19/22; H01Q 19/24; H01Q 19/28; H01Q 19/30; H01Q 21/0006; H01Q 21/0075; H01Q 21/24; H01Q 21/245; H01Q 21/205; H01Q 21/28
See application file for complete search history.

(56) References Cited

U.S. PATENT DOCUMENTS

| | | | | |
|---|---|---|---|---|
| 2013/0215832 | A1 | 8/2013 | Gao et al. | |
| 2021/0050654 | A1* | 2/2021 | Bane ..... | H01Q 1/48 |

OTHER PUBLICATIONS

Xia Bai et al., "Omnidirectional Dual Polarized Low-profile Antenna for 4G MIMO Indoor Applications",2018 IEEE,total 3 pages.
Wen Hongyun,"A Multiband Dual-Polarized Omnidirectional Antenna for 2G/3G/LTE Applications", Hunan University, Apr. 2017, with an English abstract, total 80 pages.

* cited by examiner

ANTENNA AND COMMUNICATIONS DEVICE

CROSS-REFERENCE TO RELATED APPLICATION

This application claims priority to Chinese Patent Application No. 202010431622.5, filed on May 20, 2020, which is hereby incorporated by reference in its entirety.

TECHNICAL FIELD

This application relates to the field of antenna technologies, and in particular, to an antenna and a communications device.

BACKGROUND

In a wireless local area network (WLAN) service, to improve signal bandwidth of an access point (AP), more antennas may be integrated into the AP to increase a quantity of signal streams, and a combination of different polarized antennas may be used in the AP to reduce a channel correlation. For example, a horizontally polarized antenna and a vertically polarized antenna that are disposed in a superposition manner may be used in the AP.

A distance between the horizontally polarized antenna and the vertically polarized antenna is usually relatively short, to reduce a height of an antenna and implement low-profile design of the antenna.

However, because the horizontally polarized antenna is usually fed through a coaxial cable, an induced current is generated in a feeding process through the coaxial cable, and the induced current causes interference to signals received and transmitted by the vertically polarized antenna. In other words, isolation between the horizontally polarized antenna and the vertically polarized antenna is relatively low.

SUMMARY

The application provides an antenna and a communications device, to resolve a problem that isolation between a horizontally polarized antenna and a vertically polarized antenna is relatively low. Technical solutions are as follows:

In at least one embodiment, an antenna is provided, and the antenna includes a horizontally polarized antenna and a vertically polarized antenna that are disposed in a superposition manner. The horizontally polarized antenna includes a substrate, at least one radiation element, at least one double-sided parallel strip line (DSPSL), and a metal sheet and a coaxial cable that are located on a first side of the substrate. The first side is a side that is of the substrate and that is away from the vertically polarized antenna. The double-sided parallel strip line is connected to the radiation element. The metal sheet is connected to a conductor that is of the double-sided parallel strip line and that is located on the first side, and a diameter of a maximum inscribed circle of the metal sheet is greater than a line width of the double-sided parallel strip line. A first conductor of the coaxial cable is connected to the metal sheet, and a second conductor of the coaxial cable is connected, through a through hole on the substrate, to a conductor that is of the double-sided parallel strip line and that is located on a second side.

The diameter of the maximum inscribed circle of the metal sheet is greater than the linewidth of the double-sided parallel strip line, and both the metal sheet and the coaxial cable are located on the first side of the substrate. Therefore, the metal sheet can suppress an induced current in the coaxial cable, and impact of the induced current on the vertically polarized antenna can be reduced.

In an embodiment, the diameter of the maximum inscribed circle of the metal sheet is about 0.18 to 0.5 times a waveguide wavelength, in the double-sided parallel strip line, of an electromagnetic wave of an operating frequency of the horizontally polarized antenna. Therefore, it can be ensured that the metal sheet can effectively suppress the induced current in the coaxial cable, and isolation between the horizontally polarized antenna and the vertically polarized antenna can be improved.

In an embodiment, the horizontally polarized antenna further includes a first feed point located on the first side and a second feed point located on the second side. The second conductor of the coaxial cable is connected to the first feed point, the first feed point is connected to the second feed point through the through hole, and the second feed point is connected to the conductor that is of the double-sided parallel strip line and that is located on the second side.

The first feed point located on the first side and the second feed point located on the second side are designed, so that the second conductor of the coaxial cable is connected to the conductor that is of the double-sided parallel strip line and that is located on the second side.

In an embodiment, the metal sheet has a via hole, and the horizontally polarized antenna further includes a stub located on the first side and in the via hole. The stub is connected to the second conductor of the coaxial cable, and the stub may be used to adjust impedance of the horizontally polarized antenna.

In an embodiment, the first feed point is located in the via hole, the first feed point and the stub form an integrated structure, and a shape of the via hole is the same as a shape of an orthographic projection of the integrated structure on the substrate. In addition, a gap exists between the integrated structure and the via hole, in other words, the integrated structure is insulated from the metal sheet.

The shape of the via hole is designed to be the same as the shape of the integrated structure. Therefore, it can be ensured that a size of the via hole is not increased when the integrated structure is disposed in the via hole, and it can be ensured that the metal sheet can effectively suppress the induced current in the coaxial cable.

In an embodiment, both a distance between the first feed point and the via hole and a distance between the stub and the via hole are greater than or equal to 0.1 millimeter and less than or equal to 2 millimeters.

In an embodiment, the metal sheet is disk-shaped, and the metal sheet may also be referred to as a feed panel.

In an embodiment, the radiation element is a dipole element. The vertically polarized antenna may be a monopole antenna.

In an embodiment, the first conductor of the coaxial cable is an outer conductor of the coaxial cable, and the second conductor of the coaxial cable is an inner conductor of the coaxial cable.

In at least one embodiment, a communications device is provided. The communications device includes a radio frequency circuit and the antenna, as described herein. The radio frequency circuit is connected to the coaxial cable in the antenna, to feed the horizontally polarized antenna in the antenna.

In conclusion, the application provides the antenna and the communications device. In the solutions provided in the application, the antenna includes the horizontally polarized antenna and the vertically polarized antenna. The horizontally polarized antenna includes the metal sheet, and the metal sheet can be separately connected to the double-sided parallel strip line in the horizontally polarized antenna and the first conductor of the coaxial cable. The diameter of the maximum inscribed circle of the metal sheet is greater than the line width of the double-sided parallel strip line, and both the metal sheet and the coaxial cable are located on the first side of the substrate. Therefore, the metal sheet can effectively suppress the induced current in the coaxial cable, and impact of the induced current on the vertically polarized antenna can be reduced. According to the solutions provided in the embodiments of the application, the isolation between the horizontally polarized antenna and the vertically polarized antenna can be effectively improved while an overall height of the antenna is not increased.

DESCRIPTION OF EMBODIMENTS

The following describes, in detail with reference to the accompanying drawings, an antenna and a communications device that are provided in the embodiments of the application.

Figure 1:
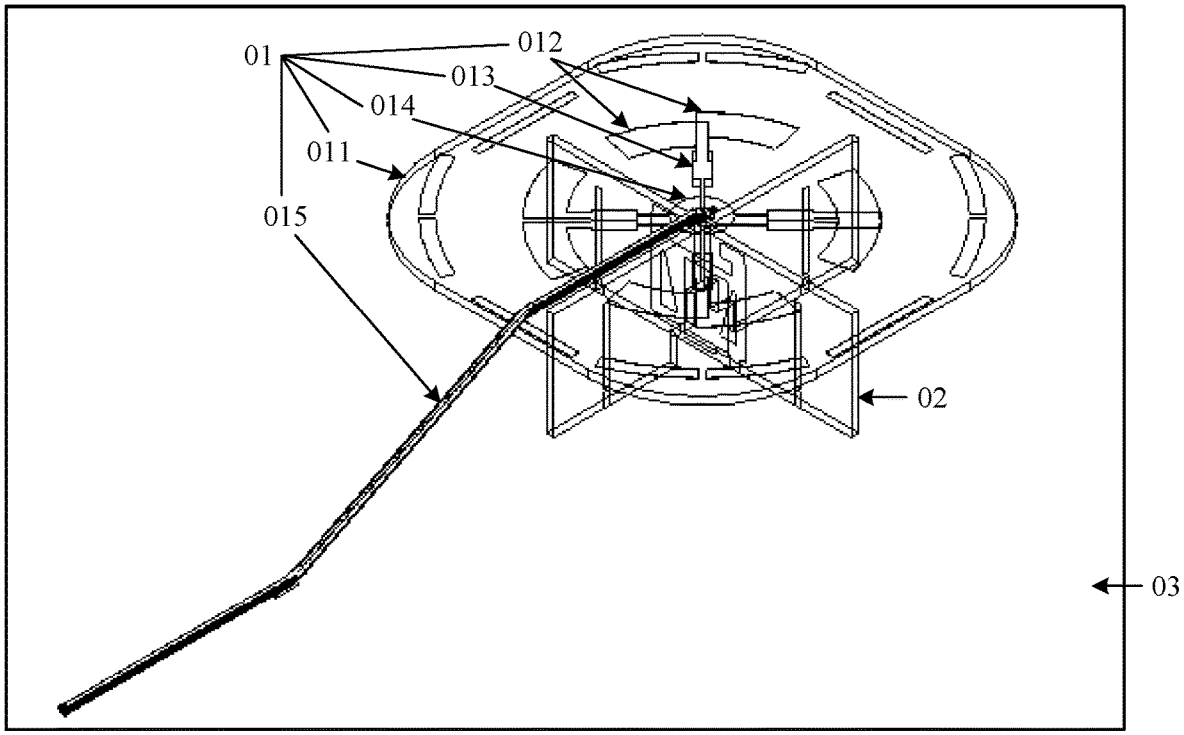
FIG. 1 is a schematic structural diagram of an antenna according to an embodiment of the application.
Figure 2:
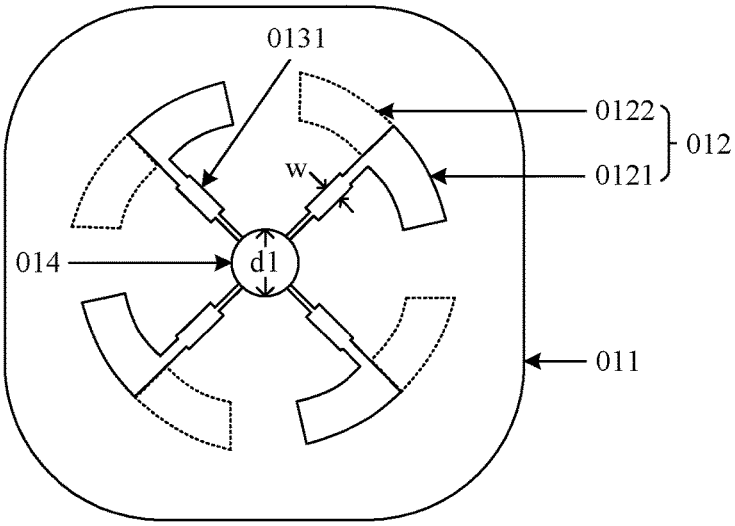
FIG. 2 is a top view of a first side of a horizontally polarized antenna according to an embodiment of the application.
Figure 3:
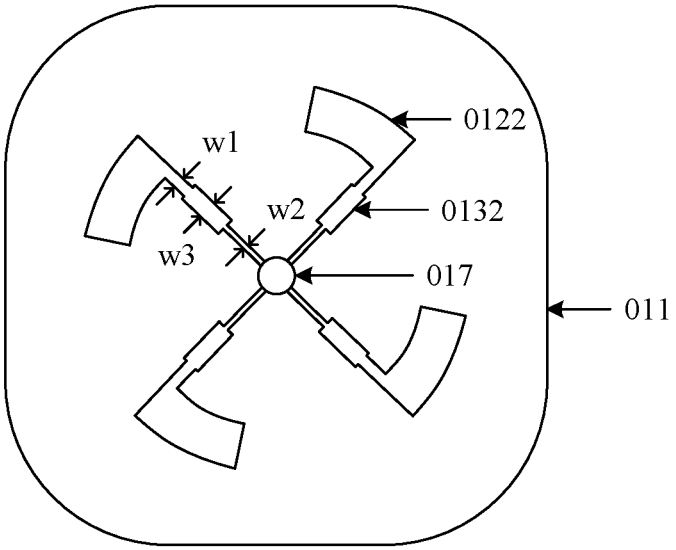
FIG. 3 is a top view of a second side of a horizontally polarized antenna according to an embodiment of the application.

An embodiment of the application provides an antenna. As shown in FIG. 1, the antenna includes a horizontally polarized antenna 01 and a vertically polarized antenna 02 that are disposed in a superposition manner. FIG. 2 is a top view of a first side of a horizontally polarized antenna according to an embodiment of the application. FIG. 3 is a top view of a second side of a horizontally polarized antenna according to an embodiment of the application. As shown in FIG. 1 to FIG. 3, the horizontally polarized antenna 01 includes a substrate 011, at least one radiation element 012, at least one double-sided parallel strip line 013, and a metal sheet 014 and a coaxial cable 015 that are located on a first side of the substrate 011. "At least one" means one or more, and "a plurality of" means two or more. For example, FIG. 1 to FIG. 3 show four radiation elements 012 and four double-sided parallel strip lines 013. The first side refers to a side that is of the substrate 011 and that is away from the vertically polarized antenna 02.

In an embodiment of the application, a quantity of double-sided parallel strip lines 013 included in the horizontally polarized antenna 01 is equal to a quantity of radiation elements 012, and each double-sided parallel strip line 013 is connected to one radiation element 012.

With reference to FIG. 2 and FIG. 3, it can be learned that each double-sided parallel strip line 013 includes a conductor 0131 located on the first side of the substrate 011 and a conductor 0132 located on a second side of the substrate 011. The conductor 0131 and the conductor 0132 have a same shape and a same line width. In other words, an orthographic projection of the conductor 0131 on the substrate 011 overlaps an orthographic projection of the conductor 0132 on the substrate 011. The second side is parallel to the first side, and the second side is a side that is of the substrate 011 and that is close to the vertically polarized antenna 02.

As shown in FIG. 2, the metal sheet 014 is connected to the conductor 0131 that is of the double-sided parallel strip line 013 and that is located on the first side, and a diameter d1 of a maximum inscribed circle of the metal sheet 014 is greater than a line width w of the double-sided parallel strip line 013. In other words, a size of the metal sheet 014 is designed to be larger. If line widths of parts of the double-sided parallel strip line 013 are different, the diameter d1 of the maximum inscribed circle of the metal sheet 014 is greater than a maximum line width of the double-sided parallel strip line 013.

If an orthographic projection of the metal sheet 014 on the substrate 011 is a circle, the maximum inscribed circle of the metal sheet 014 is the circle. If an orthographic projection of the metal sheet 014 on the substrate 011 is an ellipse, the maximum inscribed circle of the metal sheet 014 is a circle whose center is a center of the ellipse and whose radius is a semi-minor axis of the ellipse. If an orthographic projection of the metal sheet 014 on the substrate 011 is a polygon, the maximum inscribed circle of the metal sheet 014 is a circle that has a largest area in the polygon and that is tangent to at least one side of the polygon.

Figure 4:
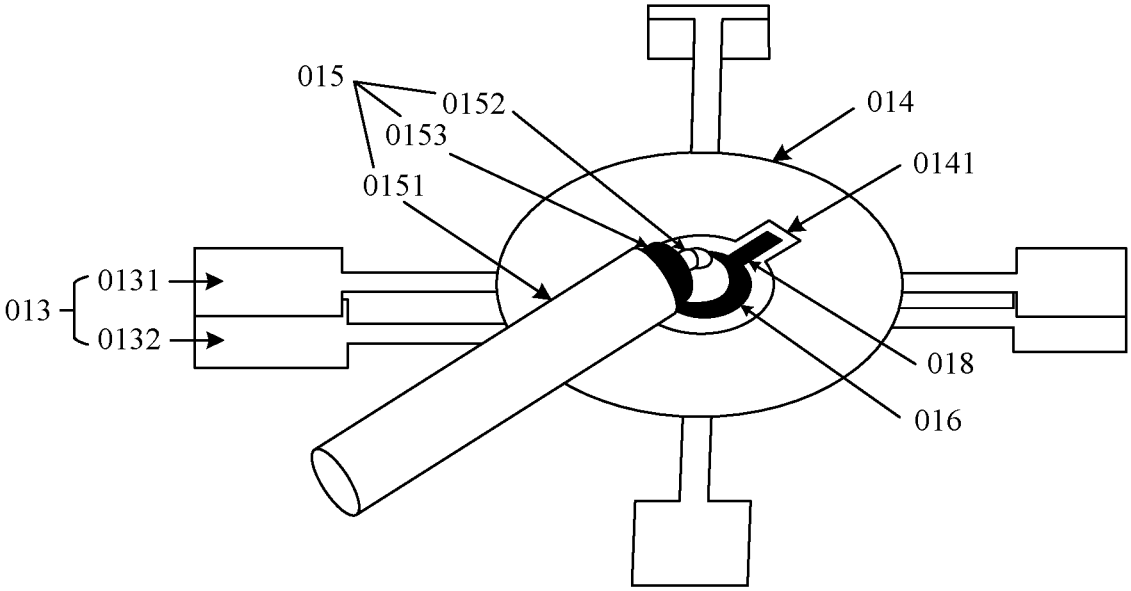
FIG. 4 is a partial schematic structural diagram of a horizontally polarized antenna according to an embodiment of the application.
Figure 5:
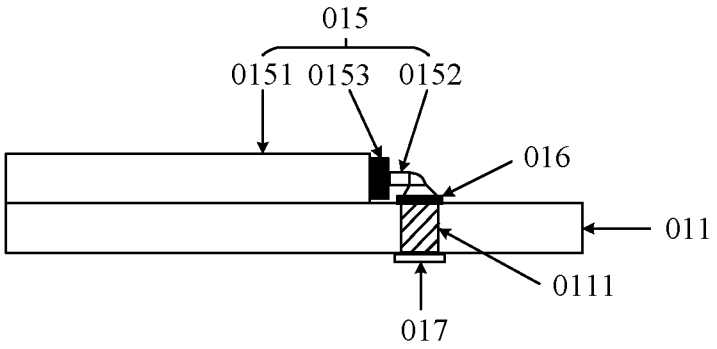
FIG. 5 is a section view of a horizontally polarized antenna according to an embodiment of the application.

FIG. 4 is a partial schematic structural diagram of a horizontally polarized antenna according to an embodiment of the application. FIG. 5 is a section view of a horizontally polarized antenna according to an embodiment of the application. As shown in FIG. 4 and FIG. 5, a first conductor 0151 of the coaxial cable 015 is connected to the metal sheet 014. For example, the first conductor 0151 may be welded to the metal sheet 014. A second conductor 0152 of the coaxial cable 015 is connected, through a through hole 0111 on the substrate 011, to the conductor 0132 that is of the double-sided parallel strip line 013 and that is located on the second side. The through hole 0111 may be a plated through hole.

In an embodiment of the application, the first conductor 0151 of the coaxial cable 015 is one of an inner conductor and an outer conductor, and the second conductor 0152 is the other conductor in the inner conductor and the outer conductor. In addition, referring to FIG. 4 and FIG. 5, the coaxial cable 015 further includes an insulation layer 0153 located between the inner conductor and the outer conductor, and an outer protective sleeve (not shown in FIG. 4 and FIG. 5) wrapping the outer conductor.

Both the metal sheet 014 and the coaxial cable 015 are located on the first side of the substrate, and the first conductor 0151 of the coaxial cable 015 is connected to the metal sheet 014. Therefore, a distance between the metal sheet 014 and a part that is of the coaxial cable 015 and that is located in an area in which the metal sheet 014 is located is relatively short. For example, the outer protective sleeve of the coaxial cable 015 may be pressed against the metal sheet 014. The metal sheet 014 performs a coupling function for an induced current in the coaxial cable 015, that is, the metal sheet 014 may generate a coupling current. The coupling current can suppress the induced current in the coaxial cable 015. Therefore, impact of the coaxial cable 015 on the vertically polarized antenna 02 is reduced, in other words, isolation between the horizontally polarized antenna 01 and the vertically polarized antenna 02 is improved.

Because the metal sheet 014 is further connected to the conductor 0131 that is of the double-sided parallel strip line 013 and that is located on the first side of the substrate 011, an amplitude and a phase of the coupling current generated by the metal sheet 014 are related to an operating frequency of the antenna, the size of the metal sheet 014, and a length of the double-sided parallel strip line 013. In an embodiment of the application, after the operating frequency of the horizontally polarized antenna 01 and the length of the double-sided parallel strip line 013 are determined, the size of the metal sheet 014 may be properly designed, to ensure that the isolation between the horizontally polarized antenna 01 and the vertically polarized antenna 02 can meet an isolation requirement at each frequency point on an operating frequency band of the antenna.

In conclusion, an embodiment of the application provides the antenna, the antenna includes the horizontally polarized antenna and the vertically polarized antenna. The horizontally polarized antenna includes the metal sheet, and the metal sheet can be separately connected to the double-sided parallel strip line in the horizontally polarized antenna and the first conductor of the coaxial cable. The diameter of the maximum inscribed circle of the metal sheet is greater than the line width of the double-sided parallel strip line, and both the metal sheet and the coaxial cable are located on the first side of the substrate. Therefore, the metal sheet can effectively suppress the induced current in the coaxial cable, so that impact of the induced current on the vertically polarized antenna can be reduced. According to the solution provided in an embodiment of the application, the isolation between the horizontally polarized antenna and the vertically polarized antenna can be effectively improved while an overall height of the antenna is not increased.

In an embodiment of the application, each radiation element 012 is a radiation element printed on two sides. Referring to FIG. 2 to FIG. 4, it can be learned that each radiation element 012 includes a first arm 0121 located on the first side of the substrate 011 and a second arm 0122 located on the second side of the substrate 011. The first arm 0121 is connected to the conductor 0131 that is of the double-sided parallel strip line 013 and that is located on the first side of the substrate 011, and the second arm 0122 is connected to the conductor 0132 that is of the double-sided parallel strip line 013 and that is located on the second side of the substrate 011.

Correspondingly, the coaxial cable 015 may feed the first arm 0121 in the radiation element 012 through the metal sheet 014 and the conductor 0131 that is of the double-sided parallel strip line 013 and that is located on the first side, and may feed the second arm 0122 in the radiation element 012 through the conductor 0132 that is of the double-sided parallel strip line 013 and that is located on the second side.

In an embodiment, the diameter of the maximum inscribed circle of the metal sheet 014 is about 0.18 to 0.5 times a waveguide wavelength, in the double-sided parallel strip line 013, of an electromagnetic wave of the operating frequency of the horizontally polarized antenna 01. The diameter range can ensure that the coupling current generated by the metal sheet 014 can effectively suppress the induced current in the coaxial cable 015 at each frequency point on the operating frequency band of the antenna, and further ensure that the isolation between the horizontally polarized antenna 01 and the vertically polarized antenna 02 can meet the isolation requirement at each frequency point on the operating frequency band of the antenna.

The waveguide wavelength is a wavelength of the electromagnetic wave, transmitted in a medium of the double-sided parallel strip line 013, of the operating frequency of the horizontally polarized antenna 01 when the horizontally polarized antenna 01 operates. The waveguide wavelength is related to the operating frequency of the horizontally polarized antenna 01 (e.g., a frequency of the electromagnetic wave), the line width of the double-sided parallel strip line 013, a dielectric constant of the substrate 011, and a thickness of the substrate 011. The line width of the double-sided parallel strip line 013 has relatively small impact on the waveguide wavelength. Therefore, impact of a line width difference between the parts of the double-sided parallel strip line 013 on the waveguide wavelength may be negligible.

In an embodiment, referring to FIG. 3 to FIG. 5, the horizontally polarized antenna 01 may further include a first feed point 016 located on the first side of the substrate 011 and a second feed point 017 located on the second side of the substrate 011.

The second conductor 0152 of the coaxial cable 015 is connected to the first feed point 016. For example, the second conductor 0152 is welded to the first feed point 016. The first feed point 016 is connected to the second feed point 017 through the through hole 0111, and the second feed point 017 is connected to the conductor 0132 that is of the double-sided parallel strip line 013 and that is located on the second side. That is, the second conductor 0152 of the coaxial cable 015 may be connected, through the first feed point 016 and the second feed point 017, to the conductor 0132 that is of the double-sided parallel strip line 013 and that is located on the second side.

The first feed point 016 is designed to be located on the first side and the second feed point 017 is designed to be located on the second side, so that the second conductor 0152 of the coaxial cable 015 is connected to the conductor 0132 that is of the double-sided parallel strip line 013 and that is located on the second side.

Figure 6:
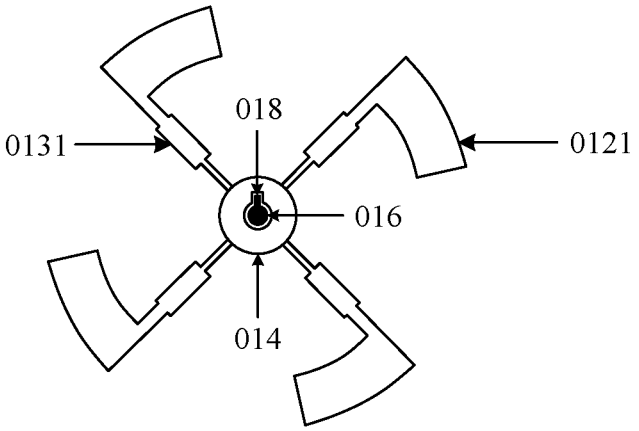
FIG. 6 is another top view of a first side of a horizontally polarized antenna according to an embodiment of the application.

FIG. 6 is another schematic structural diagram of a first side of a horizontally polarized antenna according to an embodiment of the application. With reference to FIG. 4 and FIG. 6, it can be learned that there is a via hole 0141 on the metal sheet 014, and the horizontally polarized antenna 01 may further include a stub 018 located on the first side of the substrate 011 and in the via hole 0141. The stub 018 is connected to the second conductor 0152 of the coaxial cable 015. The stub 018 may be used to adjust impedance of the horizontally polarized antenna 01.

In an embodiment of the application, the impedance of the horizontally polarized antenna 01 may be adjusted by adjusting a length of the stub 018. For example, during design of the horizontally polarized antenna 01, the stub 018 with a relatively long length may be designed on the substrate 011. Due to factors such as a production process, impedance of a horizontally polarized antenna 01 produced in each batch may be different. Therefore, after the horizontally polarized antenna 01 is manufactured according to the design, the impedance of the horizontally polarized antenna 01 may be tested. If it is tested that the impedance of the horizontally polarized antenna 01 does not meet a design requirement, the length of the stub 018 of the horizontally polarized antenna 01 produced in the batch may be shortened based on a test result. For example, a part of the stub 018 may be removed, so as to flexibly adjust the impedance of the horizontally polarized antenna 01.

Still with reference to FIG. 4 and FIG. 6, the first feed point 016 is located in the via hole 0141, and the first feed point 016 and the stub 018 form an integrated structure. A shape of the via hole 0141 may be the same as a shape of an orthographic projection of the integrated structure on the substrate 011, and a gap exists between the integrated structure and the via hole 0141, in other words, the integrated structure is insulated from the metal sheet 014.

A via hole is designed to have the shape the same as the shape of the integrated structure, to ensure that the integrated structure can be disposed in the via hole and insulated from the metal sheet without increasing a size of the via hole, and ensure that the metal sheet can effectively suppress the induced current in the coaxial cable.

Figure 7:
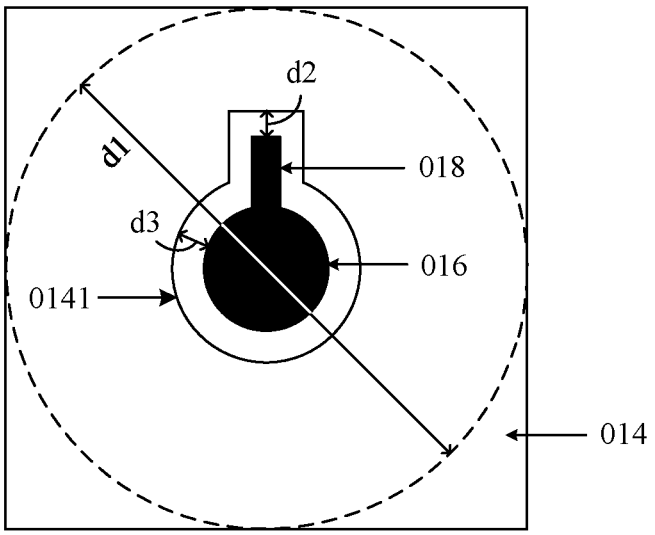
FIG. 7 is a partial schematic structural diagram of a first side of a horizontally polarized antenna according to an embodiment of the application.

In an embodiment of the application, as shown in FIG. 7, both a distance d2 between the first feed point 016 and the via hole 0141 and a distance d3 between the stub 018 and the via hole 0141 are greater than or equal to 0.1 millimeter and less than or equal to 2 millimeters.

In an embodiment, as shown in FIG. 4 and FIG. 5, the first conductor 0151 of the coaxial cable 015 is an outer conductor of the coaxial cable 015, and the second conductor 0152 of the coaxial cable 015 is an inner conductor of the coaxial cable 015. That is, the outer conductor of the coaxial cable 015 is connected, through the metal sheet 014, to the conductor 0131 that is of the double-sided parallel strip line 013 and that is located on the first side; and the inner conductor of the coaxial cable 015 is connected, through the first feed point 016, the through hole 0111, and the second feed point 017, to the conductor 0132 that is of the double-sided parallel strip line 013 and that is located on the second side.

Figure 8:
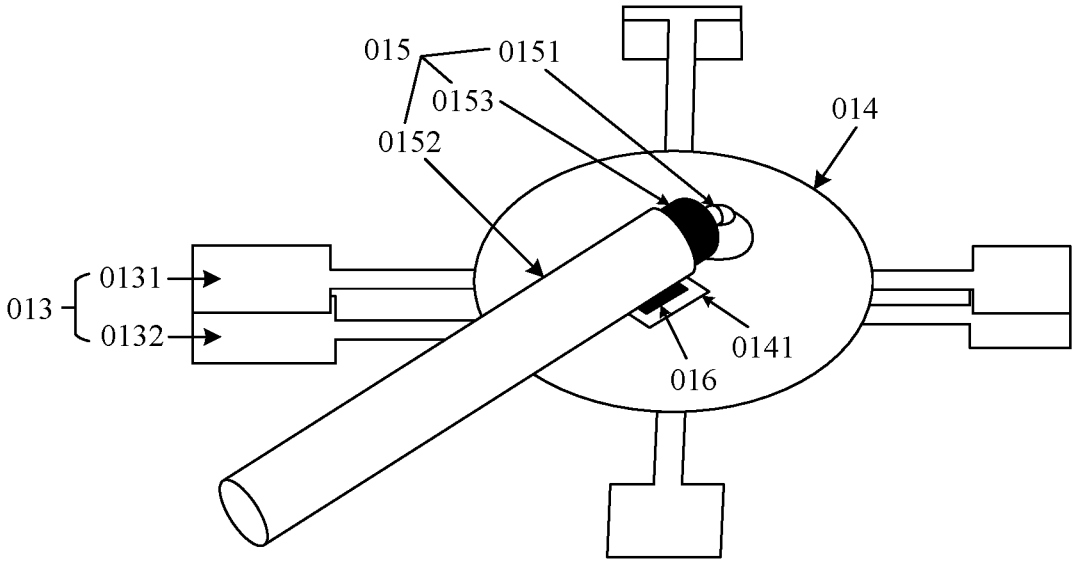
FIG. 8 is another partial schematic structural diagram of a horizontally polarized antenna according to an embodiment of the application.
Figure 9:
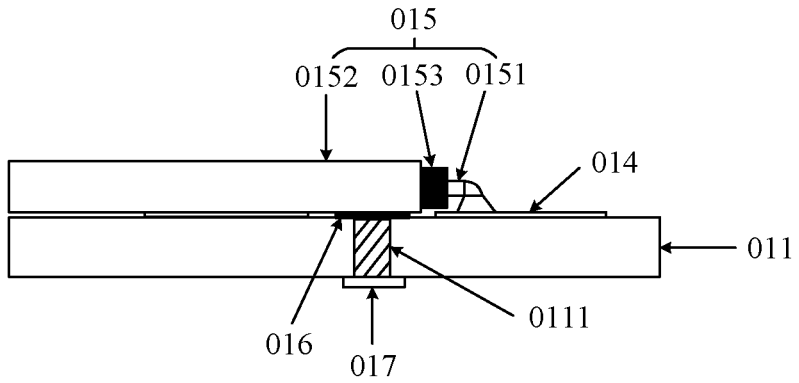
FIG. 9 is another section view of a horizontally polarized antenna according to an embodiment of the application.
Figure 10:
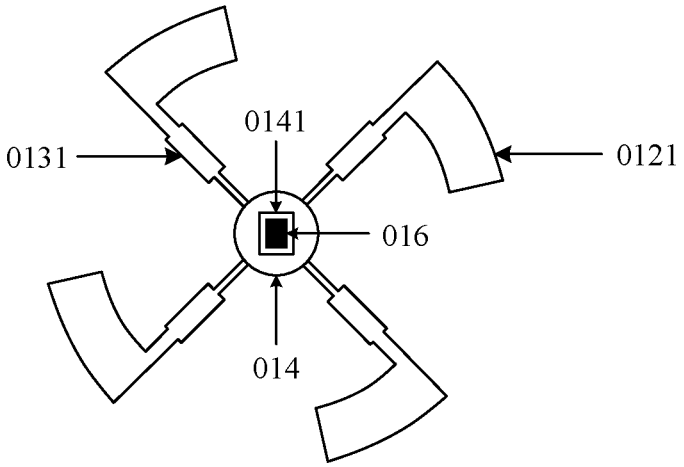
FIG. 10 is still another top view of a first side of a horizontally polarized antenna according to an embodiment of the application.

In another embodiment, as shown in FIG. 8, FIG. 9 and FIG. 10, the first conductor 0151 of the coaxial cable 015 is an inner conductor of the coaxial cable 015, and the second conductor 0152 of the coaxial cable 015 is an outer conductor of the coaxial cable 015. That is, the inner conductor of the coaxial cable 015 is connected, through the metal sheet 014, to the conductor 0131 that is of the double-sided parallel strip line 013 and that is located on the first side. The outer conductor of the coaxial cable 015 is connected, through the first feed point 016, the through hole 0111, and the second feed point 017, to the conductor 0132 that is of the double-sided parallel strip line 013 and that is located on the second side.

In an embodiment of the application, the metal sheet 014 may be disk-shaped. In other words, an orthographic projection of the metal sheet 014 on the substrate 011 is a circle. Certainly, the metal sheet 014 may alternatively be in another shape. For example, an orthographic projection of the metal sheet 014 on the substrate 011 may be a polygon such as a triangle or a rectangle. In an embodiment, an orthographic projection of the metal sheet 014 on the substrate 011 may be a regular polygon, to ensure symmetry of an overall structure of the antenna. For example, the orthographic projection of the metal sheet 014 on the substrate 011 may be a square shown in FIG. 7, and a diameter d1 of a maximum inscribed circle of the square is greater than the line width of the double-sided parallel strip line 013.

In an embodiment, as shown in FIG. 3, FIG. 4, FIG. 6, and FIG. 7, both the first feed point 016 and the second feed point 017 may be disk-shaped. In other words, orthographic projections of both the first feed point 016 and the second feed point 017 on the substrate 011 are circles. Alternatively, the first feed point 016 and the second feed point 017 may be in another shape. For example, referring to FIG. 10, an orthographic projection of the first feed point 016 on the substrate 011 may alternatively be a rectangle. In addition, both a diameter of a maximum inscribed circle of the first feed point 016 and a diameter of a maximum inscribed circle of the second feed point 017 are greater than a diameter of the through hole 0111. Therefore, it can be ensured that the first feed point 016 and the second feed point 017 can be effectively connected through the through hole 0111.

In an embodiment of the application, a quantity of the at least one radiation element 012 included in the horizontally polarized antenna 01 may be greater than 1. For example, the quantity of the at least one radiation element 012 may be greater than or equal to 3. In addition, the at least one radiation element 012 is centrosymmetric or axisymmetric with respect to a center point of the metal sheet 014. The center point of the metal sheet 014 may be a center of the maximum inscribed circle of the metal sheet 014.

For example, as shown in FIG. 1 to FIG. 4, the horizontally polarized antenna may include four radiation elements 012, and the four radiation elements 012 are centrosymmetric with respect to the center point of the metal sheet 014.

In an embodiment of the application, if the horizontally polarized antenna 01 includes N (N is an integer greater than 1) radiation elements 012, the horizontally polarized antenna 01 may also be referred to as an N-element antenna. Correspondingly, the horizontally polarized antenna 01 includes N double-sided parallel strip lines 013, and the N double-sided parallel strip lines 013 can form a feed network, to transfer, to the N radiation elements 012, energy transmitted through the coaxial cable 015, so as to feed the N radiation elements 012.

Because the energy transmitted through the coaxial cable 015 can be separately transferred to the N double-sided parallel strip lines 013 through the metal sheet 014, the first feed point 016, and the second feed point 017, the metal sheet 014, the first feed point 016, and the second feed point 017 may form a one-to-N power splitter. The one-to-N power splitter can divide the energy transmitted through the coaxial cable 015 into N channels, and respectively transmit the N channels of energy to the N double-sided parallel strip lines 013.

In an embodiment of the application, line widths at two ends of each double-sided parallel strip line 013 may be less than a line width in a middle part of the double-sided parallel strip line 013. For example, as shown in FIG. 3, a line width w1 at an end that is of a double-sided parallel strip line 013 and that is connected to a radiation element 012 may be less than a line width w3 in a middle part of the double-sided parallel strip line 013, and may be greater than a line width w2 at an end that is of the double-sided parallel strip line 013 and that is connected to the coaxial cable 015. That is, line widths of the parts of the double-sided parallel strip line 013 meet the following requirement: w3>w1>w2.

The line widths of the parts of the double-sided parallel strip line 013 are designed, to implement impedance matching for the horizontally polarized antenna 01.

In an embodiment of the application, each radiation element 012 may be a dipole element. Referring to FIG. 1 to FIG. 3 and FIG. 6, the first arm 0121 and the second arm 0122 that are included in the dipole element 012 are arranged symmetrically by using an axis of the double-sided parallel strip line 013 as an axis. That is, extension directions of the first arm 0121 and the second arm 0122 are opposite.

Certainly, the radiation element 012 may alternatively be another type of radiation element, for example, a slot radiation element. That is, the horizontally polarized antenna 01 may be a slot antenna.

In an embodiment, the vertically polarized antenna 02 may be a monopole antenna. Operating frequency bands of both the horizontally polarized antenna 01 and the vertically polarized antenna 02 may be a 5 gigahertz (GHz) frequency band.

Figure 11:
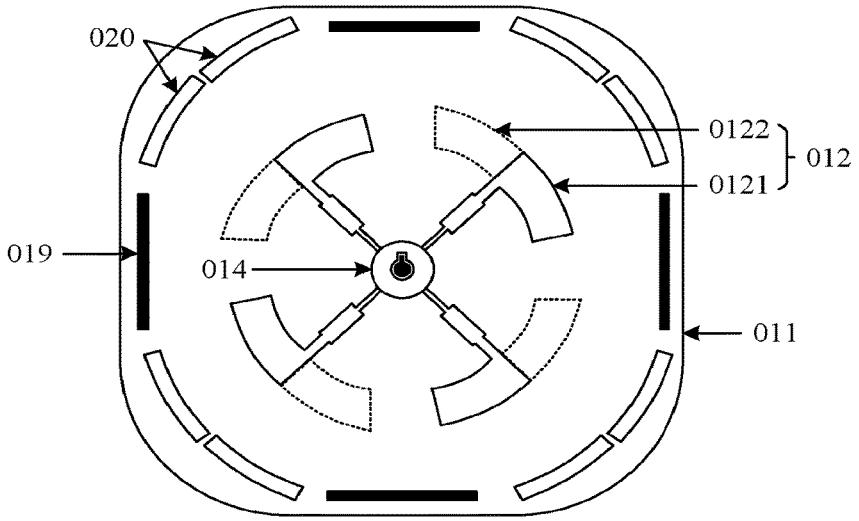
FIG. 11 is yet another top view of a first side of a horizontally polarized antenna according to an embodiment of the application.

FIG. 11 is yet another schematic structural diagram of a first side of a horizontally polarized antenna according to an embodiment of the application. As shown in FIG. 11, the horizontally polarized antenna 01 may further include a plurality of directors 019 and a plurality of reflectors 020. The plurality of directors 019 and the plurality of reflectors 020 may be used to adjust a directivity pattern of the horizontally polarized antenna. The plurality of directors 019 and the plurality of reflectors 020 are all located on the first side of the substrate 011, and are evenly arranged around the radiation elements 012.

For example, FIG. 11 shows four directors 019 and four reflectors 020.

Figure 12:
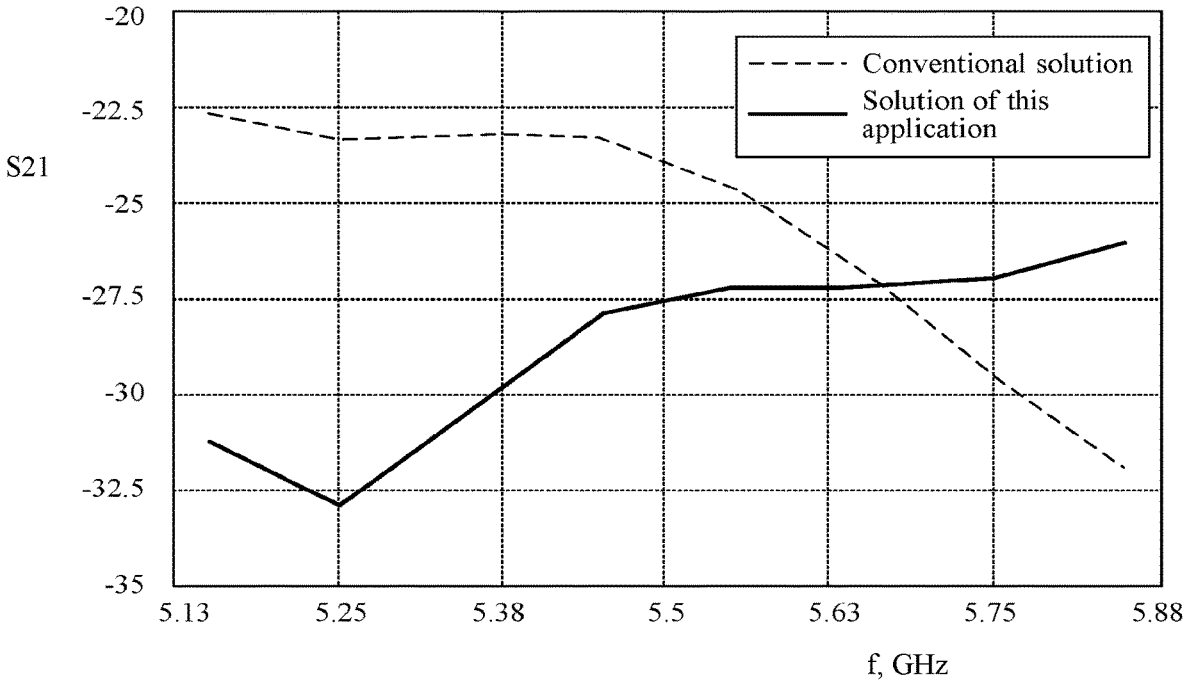
FIG. 12 is a simulation diagram of isolation between a horizontally polarized antenna and a vertically polarized antenna according to an embodiment of the application.

In an embodiment of the application, isolation between a horizontally polarized antenna and a vertically polarized antenna in a conventional solution (e.g., a solution in which no metal sheet is used) and isolation between the horizontally polarized antenna and the vertically polarized antenna in the solution provided in an embodiment of the application are simulated. Simulation parameters are as follows. Both the horizontally polarized antenna and the vertically polarized antenna operate on a 5G frequency band, the length of the double-sided parallel strip line 013 is about 0.48 times the waveguide wavelength, and the metal sheet 014 is disk-shaped and has a diameter that is about 0.2 times the waveguide wavelength. Simulation results are shown in FIG. 12. In FIG. 12, a horizontal axis represents a frequency of an antenna (f, GHz), and a vertical axis represents an S21 parameter. The S21 parameter refers to a ratio of a power of a signal received by the vertically polarized antenna to a power of a signal transmitted by the horizontally polarized antenna when the horizontally polarized antenna transmits the signal. A negative value of the S21 parameter represents the isolation between the horizontally polarized antenna and the vertically polarized antenna. It can be learned from FIG. 12 that when the horizontally polarized antenna and the vertically polarized antenna operate on the 5G frequency band, S21 parameters of the horizontally polarized antenna and the vertically polarized antenna are different at different frequency points on the 5G frequency band. In other words, isolation between the two antennas is different at different frequency points.

When a conventional feed solution is used, the S21 parameter corresponding to the horizontally polarized antenna and the vertically polarized antenna is approximately less than or equal to −22.6 dB (dB). In other words, minimum isolation between the horizontally polarized antenna and the vertically polarized antenna is approximately 22.6 dB. However, the solution provided in an embodiment of the application can ensure that the S21 parameter corresponding to the horizontally polarized antenna and the vertically polarized antenna is less than or equal to −26 dB, namely, ensure that the isolation between the horizontally polarized antenna and the vertically polarized antenna is greater than or equal to 26 dB. The minimum isolation between the horizontally polarized antenna and the vertically polarized antenna is improved by at least 3 dB compared with the conventional solution.

In conclusion, an embodiment of the application provides the antenna, the antenna includes the horizontally polarized antenna and the vertically polarized antenna. The horizontally polarized antenna includes the metal sheet, and the metal sheet can be separately connected to the double-sided parallel strip line in the horizontally polarized antenna and the first conductor of the coaxial cable. The diameter of the maximum inscribed circle of the metal sheet is greater than the line width of the double-sided parallel strip line, and both the metal sheet and the coaxial cable are located on the first side of the substrate. Therefore, the metal sheet can effectively suppress the induced current in the coaxial cable, and impact of the induced current on the vertically polarized antenna can be reduced. According to the solution provided in an embodiment of the application, the isolation between the horizontally polarized antenna and the vertically polarized antenna can be effectively improved while an overall height of the antenna is not increased.

Figure 13:
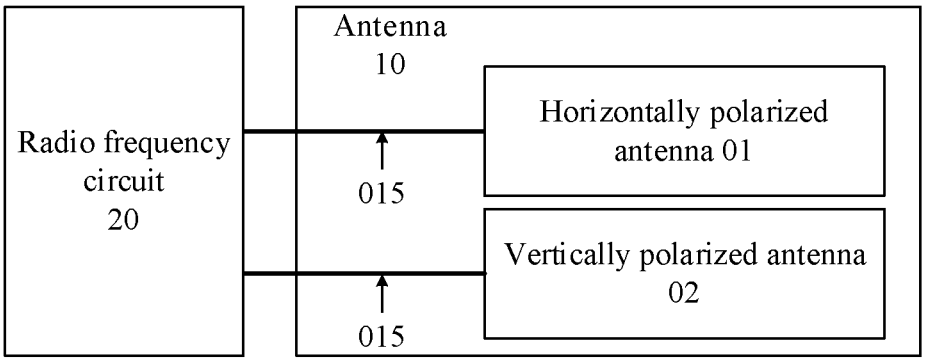
FIG. 13 is a schematic structural diagram of a communications device according to an embodiment of the application.

An embodiment of the application further provides a communications device. As shown in FIG. 13, the communications device includes an antenna 10 and a radio frequency circuit 20. The antenna 10 is the antenna provided in the foregoing embodiment, for example, may be the antenna shown in any one of FIG. 1 to FIG. 11.

As shown in FIG. 13, the radio frequency circuit 20 may be connected to a coaxial cable 015 in the antenna 10, and the radio frequency circuit 20 is used to feed a horizontally polarized antenna 01 in the antenna 10 through the coaxial cable 015.

In an embodiment, as shown in FIG. 1, the antenna may further include a metal plate 03, and the metal plate 03 is a ground plate. The vertically polarized antenna 02 may be disposed on the metal plate 03. One end that is of the coaxial cable 015 and that is connected to the horizontally polarized antenna 01 is located on the first side of the substrate 011, and the other end of the coaxial cable 015 is bent to a surface of the metal plate 03. In addition, the other end of the coaxial cable 015 may extend along the surface of the metal plate 03, and is connected to the radio frequency circuit 20.

In an embodiment of the application, a vertically polarized antenna 02 is also connected to the radio frequency circuit 20. For example, as shown in FIG. 13, the vertically polarized antenna 02 is also connected to the radio frequency circuit 20 through a coaxial cable 015. Alternatively, the antenna 10 may further include a transmission line printed on the metal plate 03, and the vertically polarized antenna 02 may be connected to the radio frequency circuit 20 through the transmission line.

In an embodiment, the communications device may be an AP or a base station.

In conclusion, an embodiment of the application provides the communications device. The communications device includes the antenna. The horizontally polarized antenna and the vertically polarized antenna in the antenna can implement relatively high isolation on a premise of a relatively small spacing between the horizontally polarized antenna and the vertically polarized antenna. This can avoid an increase in a thickness of the communications device, and facilitate design of a miniaturized product.

What is claimed is:

1. An antenna, comprising:

a horizontally polarized antenna and a vertically polarized antenna that are disposed in a superposition manner, wherein the horizontally polarized antenna comprises: a substrate;

at least one radiation element, at least one double-sided parallel strip line, a metal sheet and a coaxial cable that are located on a first side of the substrate that is away from the vertically polarized antenna, wherein the at least one double-sided parallel strip line is connected to the at least one radiation element, the metal sheet is connected to a conductor of the at least one double-sided parallel strip line that is located on the first side, and a diameter of a maximum inscribed circle of the metal sheet is greater than a line width of the at least one double-sided parallel strip line, and wherein a first conductor of the coaxial cable is connected to the metal sheet, and a second conductor of the coaxial cable is connected, through a through hole on the substrate, to a conductor of the at least one double-sided parallel strip line that is located on a second side of the substrate; and a first feed point located on the first side and a second feed point located on the second side, wherein the first feed point is connected to the second feed point through the through hole, and the second feed point is connected to the conductor of the double-sided parallel strip line that is located on the second side.

2. The antenna according to claim 1, wherein the diameter of the maximum inscribed circle of the metal sheet is 0.18 to 0.5 times a waveguide wavelength of an electromagnetic wave of an operating frequency of the horizontally polarized antenna in the at least one double-sided parallel strip line.

3. The antenna according to claim 1, wherein the second conductor of the coaxial cable is connected to the first feed point.

4. An antenna, comprising:

a horizontally polarized antenna and a vertically polarized antenna that are disposed in a superposition manner, wherein the horizontally polarized antenna comprises: a substrate; and at least one radiation element, at least one double-sided parallel strip line, a metal sheet and a coaxial cable that are located on a first side of the substrate that is away from the vertically polarized antenna, wherein the at least one double-sided parallel strip line is connected to the at least one radiation element, the metal sheet is connected to a conductor of the at least one double-sided parallel strip line that is located on the first side, and a diameter of a maximum inscribed circle of the metal sheet is greater than a line width of the at least one double-sided parallel strip line, and wherein a first conductor of the coaxial cable is connected to the metal sheet, and a second conductor of the coaxial cable is connected, through a through hole on the substrate, to a conductor of the at least one double-sided parallel strip line that is located on a second side of the substrate, and wherein the metal sheet has a via hole, and the horizontally polarized antenna further comprises: a stub located on the first side and in the via hole, wherein the stub is connected to the second conductor of the coaxial cable.

5. The antenna according to claim 4, wherein a first feed point is located in the via hole, the first feed point and the stub form an integrated structure, and a shape of the via hole is the same as a shape of an orthographic projection of the integrated structure on the substrate.

6. The antenna according to claim 5, wherein both a distance between the first feed point and the via hole and a distance between the stub and the via hole are greater than or equal to 0.1 millimeter and less than or equal to 2 millimeters.

7. The antenna according to claim 1, wherein the metal sheet is a disk-shaped metal sheet.

8. The antenna according to claim 1, wherein the at least one radiation element is a dipole element.

9. The antenna according to claim 1, wherein the first conductor of the coaxial cable is an outer conductor of the coaxial cable, and the second conductor of the coaxial cable is an inner conductor of the coaxial cable.

10. A communications device, wherein the communications device comprises a radio frequency circuit and an antenna, wherein the antenna comprises a horizontally polarized antenna and a vertically polarized antenna that are disposed in a superposition manner, wherein the horizontally polarized antenna comprises:

a substrate;

at least one radiation element, at least one double-sided parallel strip line, a metal sheet and a coaxial cable that are located on a first side of the substrate that is away from the vertically polarized antenna, wherein the at least one double-sided parallel strip line is connected to the at least one radiation element, the metal sheet is connected to a conductor of the at least one double-sided parallel strip line that is located on the first side, and a diameter of a maximum inscribed circle of the metal sheet is greater than a line width of the at least one double-sided parallel strip line, and wherein a first conductor of the coaxial cable is connected to the metal sheet, and a second conductor of the coaxial cable is connected, through a through hole on the substrate, to a conductor of the at least one double-sided parallel strip line that is located on a second side of the substrate; and a first feed point located on the first side and a second feed point located on the second side, wherein the first feed point is connected to the second feed point through the through hole, and the second feed point is connected to the conductor of the double-sided parallel strip line that is located on the second side, and wherein the radio frequency circuit is connected to the coaxial cable in the antenna.

11. The communication device according to claim 10, wherein the diameter of the maximum inscribed circle of the metal sheet is 0.18 to 0.5 times a waveguide wavelength of an electromagnetic wave of an operating frequency of the horizontally polarized antenna in the at least one double-sided parallel strip line.

12. The communication device according to claim 10, wherein the second conductor of the coaxial cable is connected to the first feed point.

13. The communication device according to claim 10, wherein the metal sheet has a via hole, and the horizontally polarized antenna further comprises: a stub located on the first side and in the via hole, wherein the stub is connected to the second conductor of the coaxial cable.

14. The communication device according to claim 13, wherein the first feed point is located in the via hole, the first feed point and the stub form an integrated structure, and a shape of the via hole is the same as a shape of an orthographic projection of the integrated structure on the substrate.

15. The communication device according to claim 14, wherein both a distance between the first feed point and the via hole and a distance between the stub and the via hole are greater than or equal to 0.1 millimeter and less than or equal to 2 millimeters.

16. The communication device according to claim 10, wherein the metal sheet is a disk-shaped metal sheet.

17. The communication device according to claim 10, wherein the at least one radiation element is a dipole element.

18. The communication device according to claim 10, wherein the first conductor of the coaxial cable is an outer conductor of the coaxial cable, and the second conductor of the coaxial cable is an inner conductor of the coaxial cable.

19. The communication device according to claim 10, wherein the at least one double-sided parallel strip line comprises a first portion having a first line width, a second portion having a second line width, and a third portion having a third line width, and wherein the third line width is greater than the first line width and the second line width.

20. The antenna according to claim 1, wherein the at least one double-sided parallel strip line comprises a first portion having a first line width, a second portion having a second line width, and a third portion having a third line width, and wherein the third line width is greater than the first line width and the second line width.

* * * * *